US010733945B2

(12) United States Patent
Zhou

(10) Patent No.: US 10,733,945 B2
(45) Date of Patent: Aug. 4, 2020

(54) LIQUID CRYSTAL DISPLAY (LCD) PANEL HAVING A CHARGE SHARING CONTROL AND A CHARGE SHARING METHOD FOR LCD PANEL

(71) Applicants: HKC Corporation Limited, Shenzhen, Guangdong (CN); Chongqing HKC Optoelectronics Technology Co., Ltd., Chongqing (CN)

(72) Inventor: Mancheng Zhou, Chongqing (CN)

(73) Assignees: HKC Corporation Limited, Shenzhen, Guangdong (CN); Congqing HKC Optoelectronics Technology Co., Ltd., Chongqing (CN)

( * ) Notice: Subject to any disclaimer, the term of this patent is extended or adjusted under 35 U.S.C. 154(b) by 116 days.

(21) Appl. No.: 15/580,442

(22) PCT Filed: Sep. 18, 2017

(86) PCT No.: PCT/CN2017/102013
§ 371 (c)(1),
(2) Date: Dec. 7, 2017

(87) PCT Pub. No.: WO2019/024187
PCT Pub. Date: Feb. 7, 2019

(65) Prior Publication Data

US 2019/0189068 A1 Jun. 20, 2019

(30) Foreign Application Priority Data

Aug. 2, 2017 (CN) ..... 2017 1 0651222

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01); *G09G 2310/0251* (2013.01)

(58) Field of Classification Search
CPC ..... G09G 2310/0251; G09G 3/3614; G09G 3/3677
See application file for complete search history.

(56) References Cited

U.S. PATENT DOCUMENTS

2015/0022510 A1* 1/2015 Yao ..... G09G 3/3659 345/211
2015/0123961 A1* 5/2015 Park ..... G09G 3/3614 345/212

(Continued)

FOREIGN PATENT DOCUMENTS

CN 102456331 A 5/2012
CN 206293145 U 6/2017

(Continued)

OTHER PUBLICATIONS

International Search Report Based on Application No. PCT/CN2017/102013 dated May 7, 2018.

*Primary Examiner* — Chun-Nan Lin
(74) *Attorney, Agent, or Firm* — Muncy, Geissler, Olds & Lowe, P.C.

(57) ABSTRACT

This application relates to a display panel. The display panel includes: a substrate, active switches are formed on the substrate; pixel units arranged in a matrix manner, where three of the pixel units form a pixel group, coupled to any data line and three scanning lines arranged in order, and the pixel group includes: a first pixel unit, coupled between a first scanning line and the data line; a second pixel unit, coupled between a second scanning line and the data line; and a third pixel unit, coupled between a third scanning line and the data line; and a charge sharing switch, where a (Continued)

control end of the charge sharing switch is connected to the first scanning line, a first end of the charge sharing switch is connected to the second pixel unit, and a second end of the charge sharing switch is connected to the third pixel unit.

9 Claims, 9 Drawing Sheets

(56) References Cited

U.S. PATENT DOCUMENTS

| | | | | |
|---|---|---|---|---|
| 2015/0235625 | A1 | 8/2015 | Chen et al. | |
| 2018/0096663 | A1* | 4/2018 | Xu | G09G 3/36 |

FOREIGN PATENT DOCUMENTS

| | | | |
|---|---|---|---|
| KR | 10-2012-0119019 | A | 10/2012 |
| TW | I556219 | B | 11/2016 |

* cited by examiner

Frame N

| | | | |
|---|---|---|---|
| + | - | + | - |
| - | + | - | + |
| + | - | + | - |
| - | + | - | + |

Frame N+1

| | | | |
|---|---|---|---|
| - | + | - | + |
| + | - | + | - |
| - | + | - | + |
| + | - | + | - |

FIG. 1b

LIQUID CRYSTAL DISPLAY (LCD) PANEL HAVING A CHARGE SHARING CONTROL AND A CHARGE SHARING METHOD FOR LCD PANEL

BACKGROUND

Technical Field

This application relates to a charge sharing method, and in particular, to a display panel and a charge sharing control method thereof.

Related Art

Liquid crystal displays (LCDs) have been widely applied in recent years. As drive technologies are improved, the LCDs have advantages such as low electric power consumption, a thin and light design, and low-voltage driving. Currently, the LCDs have been widely applied to camcorders, notebook computers, desktop displays, and various projection devices.

However, an LCD panel usually includes a gate driver circuit, a source driver circuit, and a pixel array. The pixel array includes a plurality of pixel circuits, and each pixel circuit is switched on or off according to a scanning signal provided by the gate driver circuit. Moreover, a data screen is displayed according to a data signal provided by the source driver circuit.

In a process of continuously reversing a polarity of a data line, power is continuously consumed. To improve efficiency of power use, charge sharing may be used to reduce such power consumption. Moreover, to inhibit flicker phenomena and integrate space more meticulously, when a driving manner is selected, a dot inversion driving method is usually adopted. In this way, driving may be applied to each sub-pixel, so that an optimal flicker inhibiting effect is produced. However, because a drive waveform used in a dot inversion is measured in an addressing time, and the dot inversion is a high-frequency inversion, corresponding power consumption is relatively high. Therefore, costs may be reduced by adding a charge sharing technology into the dot inversion.

SUMMARY

To resolve the foregoing technical problem, an objective of this application is to provide a display panel and a charge sharing control method thereof, where charge sharing is performed directly on pixel circuits, to prolong a charge sharing time and enhance a charge sharing effect, and charge sharing of charges may be performed by means of a dot inversion or a column inversion without being controlled by an additional timing signal, thereby improving quality of a display screen.

The objective of this application is achieved and the technical problem of this application is resolved by using the following technical solutions. A display panel provided in this application comprises: a substrate, where active switches are formed on the substrate; a plurality of pixel units arranged in a matrix manner, where three of the pixel units form a pixel group, coupled to any data line and three scanning lines arranged in order, and the pixel group comprises: a first pixel unit, coupled between a first scanning line and the data line; a second pixel unit, coupled between a second scanning line and the data line; and a third pixel unit, coupled between a third scanning line and the data line; and a charge sharing switch, where a control end of the charge sharing switch is connected to the first scanning line, a first end of the charge sharing switch is connected to the second pixel unit, and a second end of the charge sharing switch is connected to the third pixel unit.

Another objective of this application is to provide a charge sharing control method of a display panel, where the display panel comprises a plurality of pixel units arranged in a matrix manner, where three of the pixel units form a pixel group, and the pixel group is electrically coupled to a same data line and three scanning lines arranged in order, comprising: three scanning periods, where in a first scanning period, a potential of the first scanning line is pulled up, and the first pixel unit performs charging and discharging according to a signal provided by the data line; and a charge sharing switch is turned on, so that a second pixel unit is electrically coupled to a third pixel unit to perform charge sharing, where a control end of the charge sharing switch is connected to the first scanning line, a first end of the charge sharing switch is connected to the second pixel unit, and a second end of the charge sharing switch is connected to the third pixel unit.

Still another objective of this application is to provide a display panel, comprising: a substrate, where active switches are formed on the substrate; a plurality of pixel units arranged in a matrix manner, where three of the pixel units form a pixel group, coupled to any data line and three scanning lines arranged in order, and the pixel group comprises: a first pixel unit, coupled between a first scanning line and the data line; a second pixel unit, coupled between a second scanning line and the data line; and a third pixel unit, coupled between a third scanning line and the data line; and a charge sharing switch, where a control end of the charge sharing switch is connected to the first scanning line, a first end of the charge sharing switch is connected to the second pixel unit, and a second end of the charge sharing switch is connected to the third pixel unit, where the data line is a same data line or any data line.

The technical problem of this application may be further resolved by taking the following technical measures.

In an embodiment of this application, among the three scanning lines, the first scanning line is a $(2n-1)^{th}$ scanning line, the second scanning line is a $(2n)^{th}$ scanning line, and the third scanning line is a $(2n+1)^{th}$ scanning line, where n is a positive number.

In an embodiment of this application, each of the pixel units comprises an active switch, where a control end of the active switch is connected to a corresponding one of the scanning lines, a first end of the active switch is connected to the data line, and a second end of the active switch is connected to a pixel capacitor (for example, a storage capacitor and a liquid crystal capacitor); and the first end of the charge sharing switch is connected to a second end of an active switch of the second pixel unit, and the second end of the charge sharing switch is connected to a second end of an active switch of the third pixel unit.

In an embodiment of this application, in a first scanning period, a potential of the first scanning line is pulled up, the first pixel unit performs charging and discharging according to a signal provided by the data line, and the charge sharing switch is turned on, so that the second pixel unit is electrically coupled to the third pixel unit to perform charge sharing.

In an embodiment of this application, in a second scanning period, a potential of the first scanning line is pulled down, a potential of the second scanning line is pulled up, the charge sharing switch is turned off, and the second pixel unit performs charging and discharging according to a signal provided by the data line.

In an embodiment of this application, in a third scanning period, a potential of the second scanning line is pulled down, a potential of the third scanning line is pulled up, the charge sharing switch is maintained off, and the third pixel unit performs charging and discharging according to a signal provided by the data line.

In an embodiment of this application, the charge sharing control method is provided, where in a second scanning period, a potential of the first scanning line is pulled down, a potential of the second scanning line is pulled up, the charge sharing switch is turned off, and the second pixel unit performs charging and discharging according to a signal provided by the data line.

In an embodiment of this application, the charge sharing control method is provided, where in a third scanning period, a potential of the second scanning line is pulled down, a potential of the third scanning line is pulled up, the charge sharing switch is maintained off, and the third pixel unit performs charging and discharging according to a signal provided by the data line.

In this application, charge sharing is performed directly on pixel circuits, to prolong a charge sharing time and enhance a charge sharing effect, and charge sharing of charges may be performed by means of a dot inversion or a column inversion without being controlled by an additional timing signal, thereby improving quality of a display screen.

BRIEF DESCRIPTION OF THE DRAWINGS

FIG. 1*b* is a schematic diagram of an exemplary dot inversion of charges;

DETAILED DESCRIPTION

The following embodiments are described with reference to the accompanying drawings, used to exemplify specific embodiments for implementation of this application. Terms about directions mentioned in this application, such as "on", "below", "front", "back", "left", "right", "in", "out", and "side surface" merely refer to directions in the accompanying drawings. Therefore, the used terms about directions are used to describe and understand this application, and are not intended to limit this application.

The accompanying drawings and the description are considered to be essentially exemplary, rather than limitative. In the figures, units with similar structures are represented by using the same reference number. In addition, for understanding and ease of description, the size and the thickness of each component shown in the accompanying drawings are arbitrarily shown, but this application is not limited thereto.

In the accompanying drawings, for clarity, thicknesses of a circuit, a panel, an area, and the like are enlarged. In the accompanying drawings, for understanding and ease of description, thicknesses of some circuits and areas are enlarged. It should be understood that when a component such as a circuit, a film, an area, or a base is described to be "on" "another component", the component may be directly on the another component, or there may be an intermediate component.

In addition, throughout this specification, unless otherwise explicitly described to have an opposite meaning, the word "include" is understood as including the component, but not excluding any other component. In addition, throughout the specification, "on" means that one is located above or below a target component and does not necessarily mean that one is located on the top based on a gravity direction.

To further describe the technical measures taken in this application to achieve the intended inventive objective and effects thereof, specific implementations, structures, features, and effects of a display panel and a charge sharing control method thereof provided according to this application are described below in detail with reference to the accompanying drawings and preferred embodiments.

A display panel in this application may include an active array (thin film transistor, TFT) substrate, a color filter (CF) substrate, and a liquid crystal layer formed between the two substrates.

In an embodiment, the display panel in this application may be a curved-surface display panel.

In an embodiment of this application, an active array (TFT) and a color filter (CF) in this application may be formed on a same substrate.

Figure 1A:
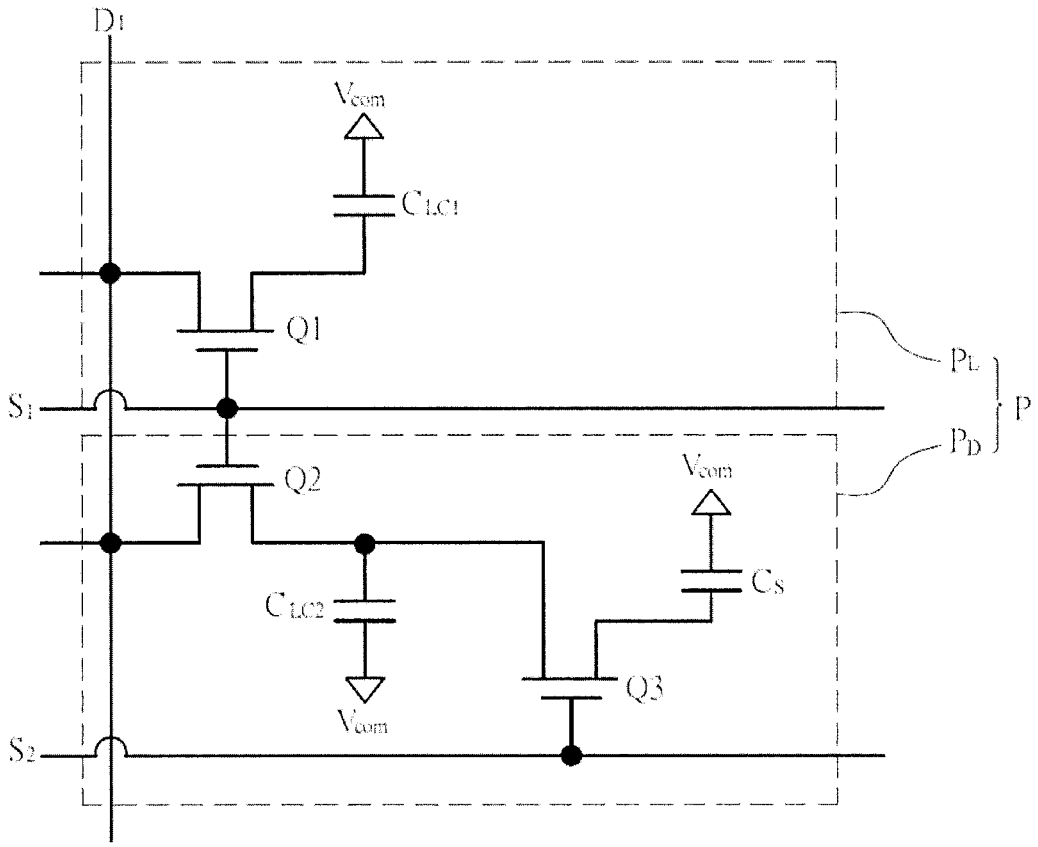
FIG. 1*a* is a schematic diagram of an exemplary circuit with a pixel divided into a light area and a dark area by using a charge sharing technology.

FIG. 1 is a schematic diagram of an exemplary circuit with a pixel divided into a light area and a dark area by using a charge sharing technology. Referring to FIG. 1, a pixel P may be divided into two sub-pixels $P_L^\circ$ and $P_D^\circ$. The sub-pixel $P_L^\circ$ includes a charging switch $Q_1^\circ$ and a liquid crystal capacitor $C_{LC1}^\circ$, and the sub-pixel $P_D$ includes a charging switch $Q_2^\circ$, a liquid crystal capacitor $C_{LC2}^\circ$, a discharging switch $Q_3^\circ$, and a storage capacitor $C_S^\circ$. The charging switch $Q_1^\circ$ is electrically connected to a scanning line $S_1^\circ$, a data line D1°, the liquid crystal capacitor $C_{LC1}^\circ$, and the charging switch $Q_2^\circ$ respectively. The charging switch $Q_2^\circ$ is electrically connected to the scanning line $S_1^\circ$, the data line D1°, the liquid crystal capacitor $C_{LC2}^\circ$, and the discharging switch $Q_3^\circ$ respectively. The discharging switch $Q_3$ is electrically connected to a scanning line $S_2^\circ$, the storage capacitor $C_S^\circ$, and the liquid crystal capacitor $C_{LC2}^\circ$ respectively. The following operating principle is described by using a column inversion as an example. That is, in a first frame time, a data line sends a positive-polarity voltage, and in a second frame time, the same data line sends a negative-polarity voltage. The operating principle is: in the first frame time, the scanning line $S_1^\circ$ sends a scanning signal to turn on the charging switch $Q_1$ and the charging switch $Q_2^\circ$ simultaneously. In this case, a display voltage (for example, a positive polarity) of the data line D1° charges the liquid crystal capacitor $C_{LC1}^\circ$ and the liquid crystal capacitor $C_{LC2}^{\circ}$. Next, when the next scanning line $S_2^{\circ}$ sends another scanning signal, the discharging switch $Q_3^{\circ}$ is turned on. In this case, charges of the liquid crystal capacitor $C_{LC2}^{\circ}$ are shared to the storage capacitor $C_S^{\circ}$, to balance voltages of the two capacitors. In the second frame time, the scanning line $S_1^{\circ}$ sends a scanning signal again to turn on the charging switch $Q_1^{\circ}$ and the charging switch $Q_2^{\circ}$ again. In this case, a display voltage (for example, a negative polarity) of the data line D1° discharges the liquid crystal capacitor $C_{LC1}^{\circ}$ and the liquid crystal capacitor $C_{LC2}^{\circ}$, so that the liquid crystal capacitor $C_{LC1}^{\circ}$ and the liquid crystal capacitor $C_{LC2}^{\circ}$ have a same negative-polarity voltage as that of the data line D1°. Next, when the next scanning line $S_2^{\circ}$ sends another scanning signal again, the discharging switch $Q_3^{\circ}$ is turned on. In this case, the storage capacitor $C_S^{\circ}$ having positive-polarity charges stored in the first frame time is finally balanced with the liquid crystal capacitor $C_{LC2}^{\circ}$ having negative-polarity charges. Therefore, the liquid crystal capacitor $C_{LC1}^{\circ}$ and the liquid crystal capacitor $C_{LC2}^{\circ}$ have different voltages, so that the pixel P has the sub-pixels $P_L^{\circ}$ and $P_D^{\circ}$ having different display voltages, and the pixel P is divided into the light area and the dark area, thereby alleviating a color cast phenomenon. In addition, in an LCD panel driven at a high frequency (for example, a driving frequency of 240 HZ), a scanning time of scanning lines may need to be increased by using a special method because a charging time of a pixel is not enough. For example, in a frame time, two adjacent scanning lines are turned on simultaneously, so that a scanning time of each scanning line in a display screen is doubled, to increase the charging time of the pixel.

FIG. 1*b* is a schematic diagram of an exemplary dot inversion of charges. Referring to FIG. 1*b*, when a pixel circuit is in Frame N, a polarity arrangement of charges stored in a charge temporary storage capacitor is shown in the schematic diagram. Charge polarities of each column are arranged to be alternatively positive and negative. However, in Frame N+1, charge polarities in a gate charge sharing circuit arranged for a dot inversion.

Figure 2:
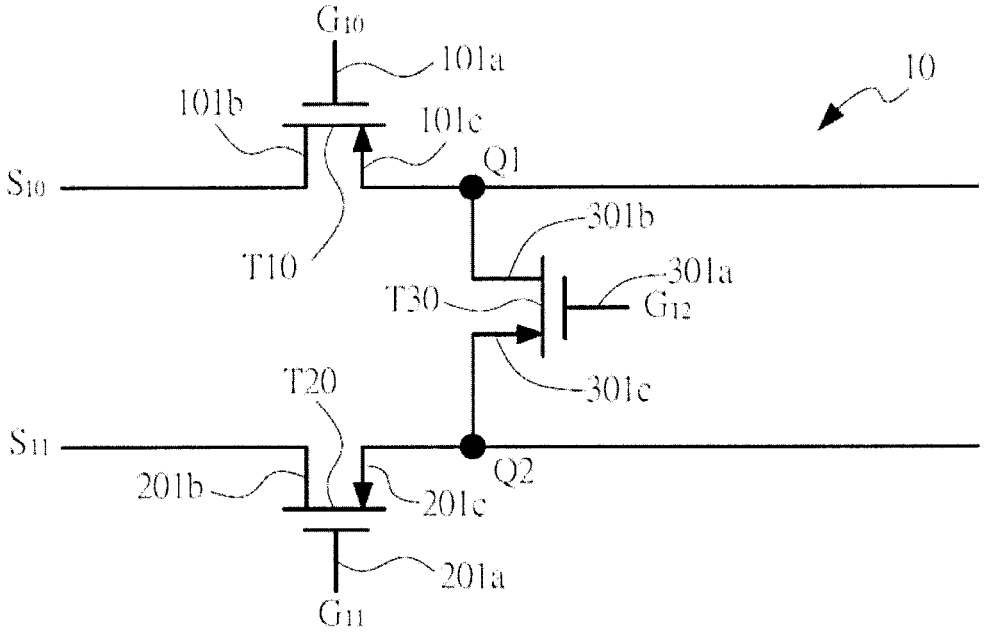
FIG. 2 is a schematic structural diagram of exemplary data line charge sharing.
Figure 3A:
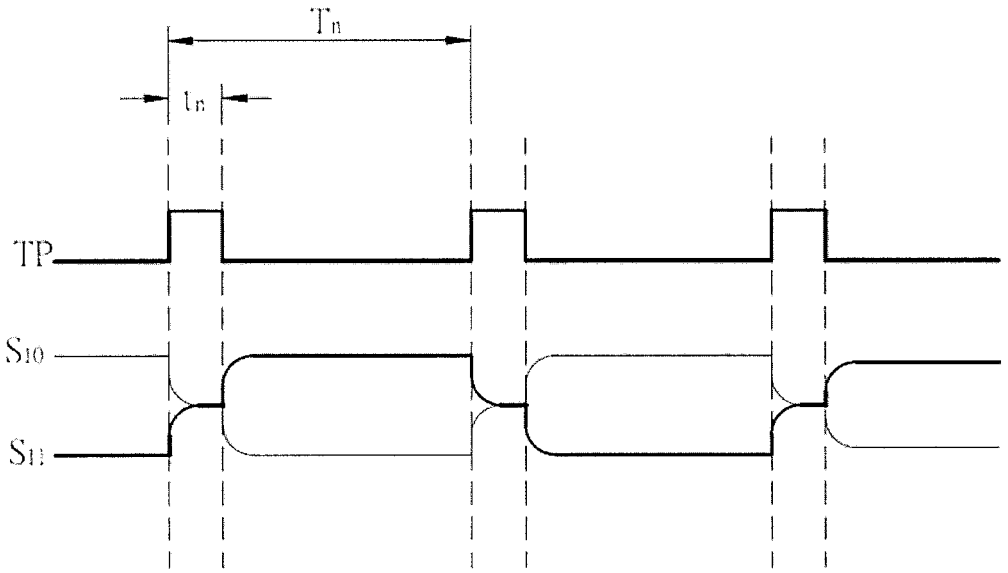
FIG. 3*a* is a waveform graph of exemplary data line charge sharing.
Figure 3B:
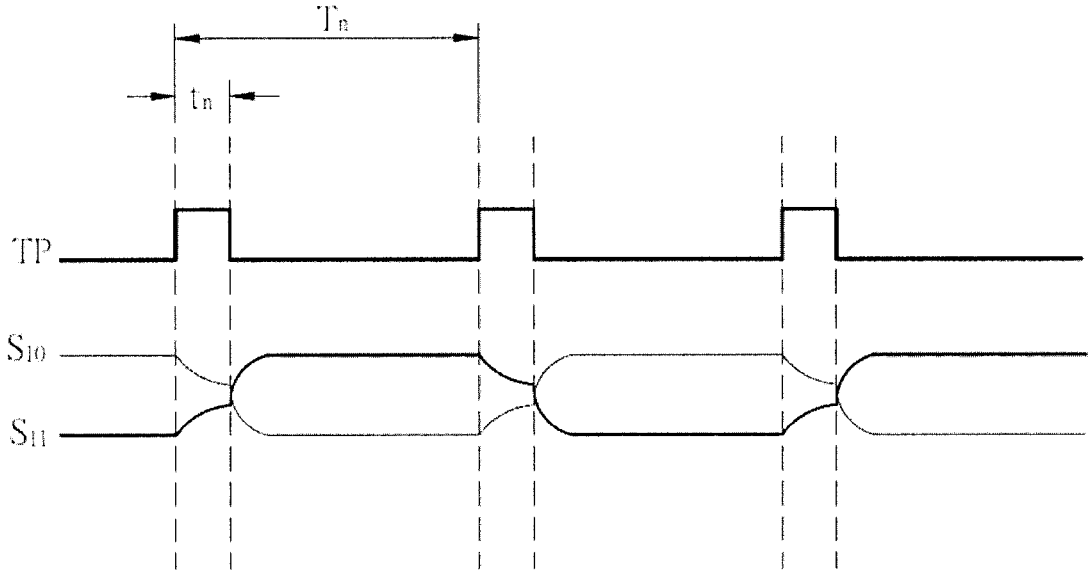
FIG. 3*b* is a waveform graph of a poor effect of exemplary data line charge sharing.

FIG. 2 is a schematic structural diagram of exemplary data line charge sharing, FIG. 3*a* is a waveform graph of exemplary data line charge sharing, and FIG. 3*b* is a waveform graph of a poor effect of exemplary data line charge sharing. Referring to FIG. 2 and FIG. 3*a*, a charge sharing structure 10 includes: a first switch T10, where a control end 101*a* of the first switch T10 is electrically coupled to a first scanning line G10, a first end 101*b* of the first switch T10 is electrically coupled to a first data line S10, and a second end 101*c* of the first switch T10 is electrically coupled to the first data line S10; a second switch T20, where a control end 201*a* of the second switch T20 is electrically coupled to a second scanning line G11, a first end 201*b* of the second switch T20 is electrically coupled to a second data line S11, and a second end 201*c* of the second switch T20 is electrically coupled to the second data line S11; and a third switch T30, where a control end 301*a* of the third switch T30 is electrically coupled to a third scanning line G12, a first end 301*b* of the third switch T30 is electrically coupled to the first data line S10, and a second end 301*c* of the third switch T30 is electrically coupled to the second data line S11. When charge sharing is performed, the first switch T10 and the second switch T20 are turned off, and the third switch T30 is turned on. Opposite charges carried in the two data lines S10 and S11 are neutralized, and voltages of the two data lines are separately recovered to values close to an intermediate value. When a gray scale voltage is reversed, starting points of positive and negative gray scale voltages become the intermediate value, to achieve a target voltage more easily, and a corresponding waveform is shown in FIG. 3*a*.

Referring to FIG. 2 and FIG. 3*b*, in an embodiment, a charge sharing time of the charge sharing structure 10 is a maintaining time in which a TP signal is at a high voltage. However, the maintaining time is very short. Consequently, charge sharing may be insufficiently performed.

Figure 4:
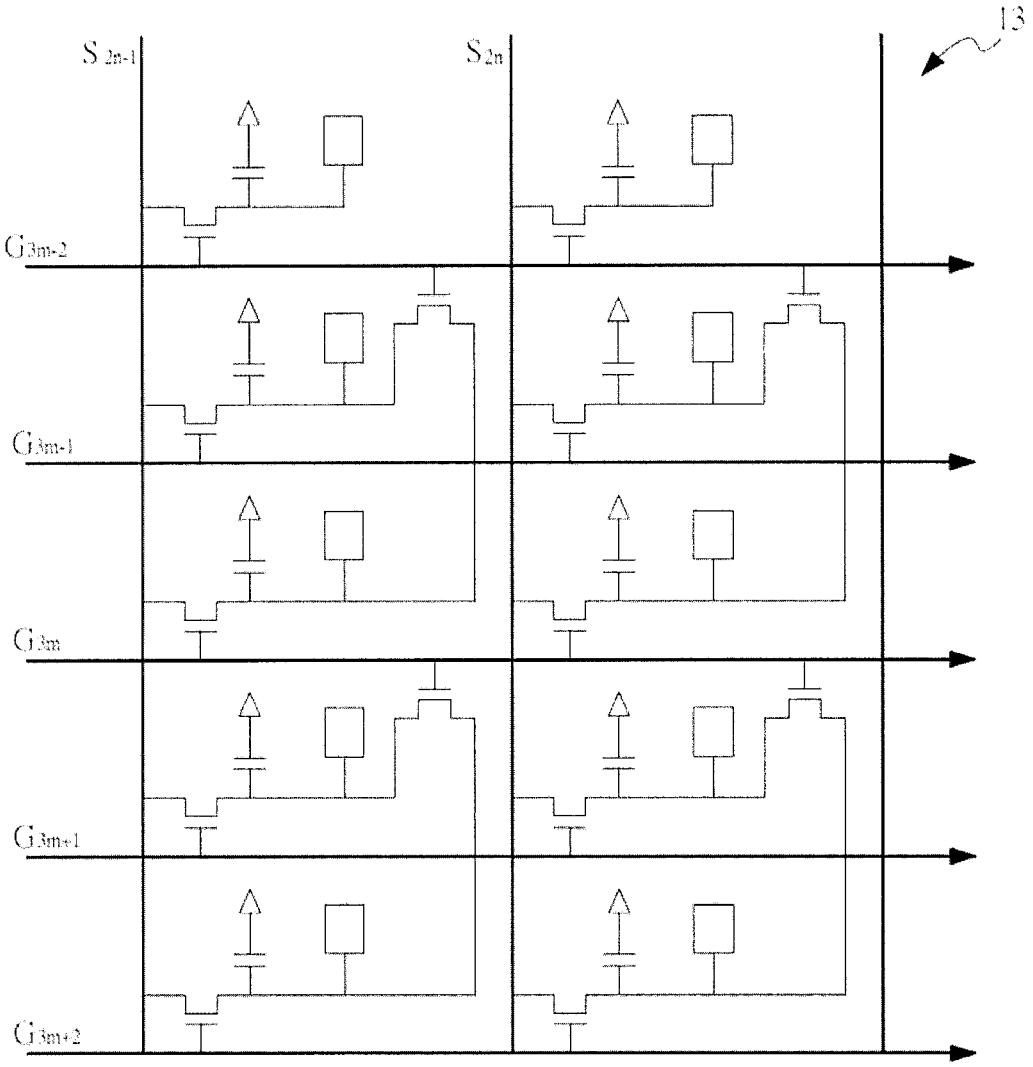
FIG. 4 is a schematic structural diagram of scanning line-controlled charge sharing according to an embodiment of this application.

FIG. 4 is a schematic structural diagram of scanning line-controlled charge sharing according to an embodiment of this application. Referring to FIG. 4, a charge sharing structure 13 control charge sharing switches by using the scanning lines, to perform charge sharing directly on a pixel circuit.

In an embodiment, a first scanning line $G_{3m-2}$ participates in charge sharing, but does not perform the charge sharing.

In an embodiment, a last scanning line $G_{3m+2}$ neither participates in charge sharing nor performs the charge sharing.

In an embodiment, for the scanning lines, the first scanning line $G_{3m-2}$ and next two scanning lines form a group (named as $G_1$, $G_2$, and $G_3$), the third scanning line $G_{3m}$ and next two scanning lines form a group (named as $G_3$, $G_4$, and $G_5$), the fifth scanning line $G_{3m+2}$ and next two scanning lines form a group (named as $G_5$, $G_6$, and $G_7$), and so on (for example, full high definition FHD has 539 groups in total).

In an embodiment, the charge sharing structure 13 directly performs charge sharing on a liquid crystal capacitor and a storage capacitor affecting screen display.

In an embodiment, the charge sharing structure 13 directly performs charge sharing on pixels of adjacent scanning lines controlled by a same data line.

Figure 5A:
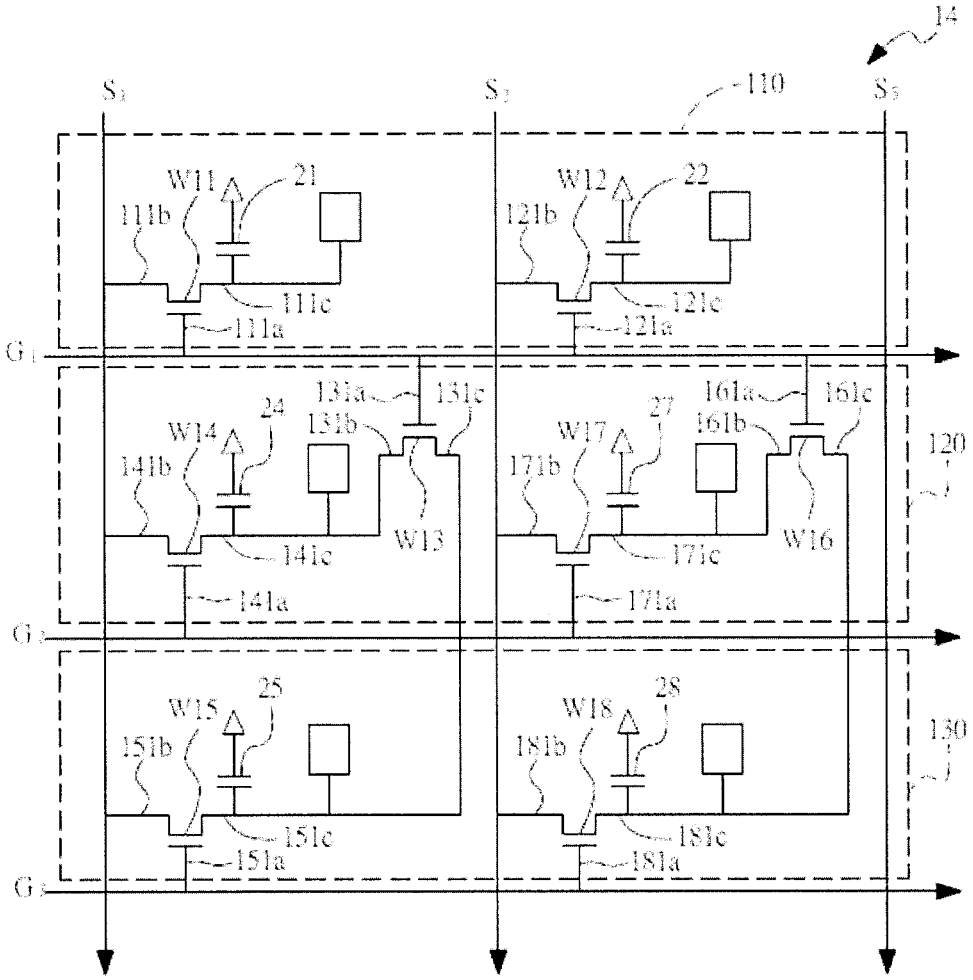
FIG. 5*a* is a schematic structural diagram of scanning line-controlled charge sharing according to another embodiment of this application.
Figure 5B:
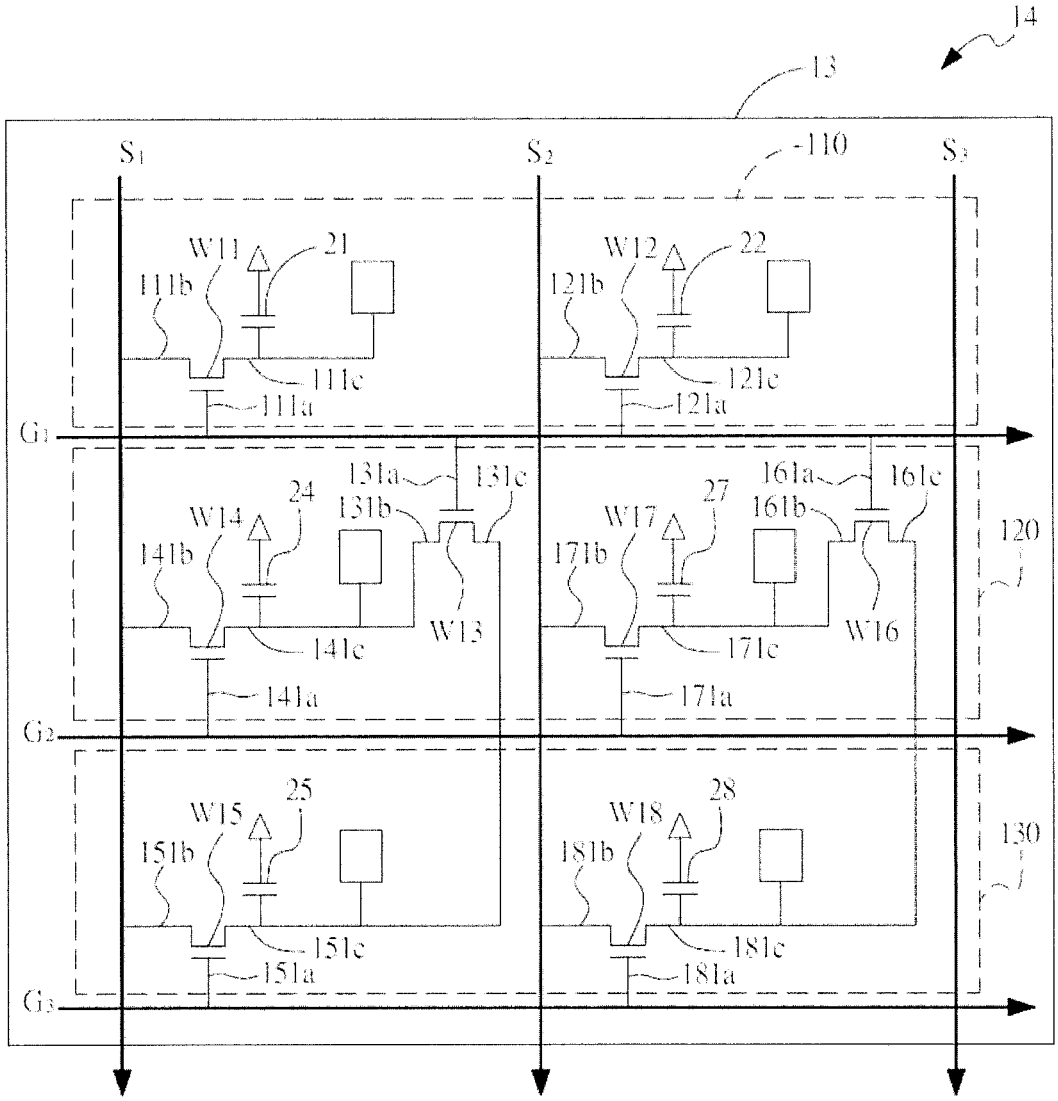
FIG. 5*b* is a schematic structural diagram of scanning line-controlled charge sharing according to still another embodiment of this application.
Figure 6:
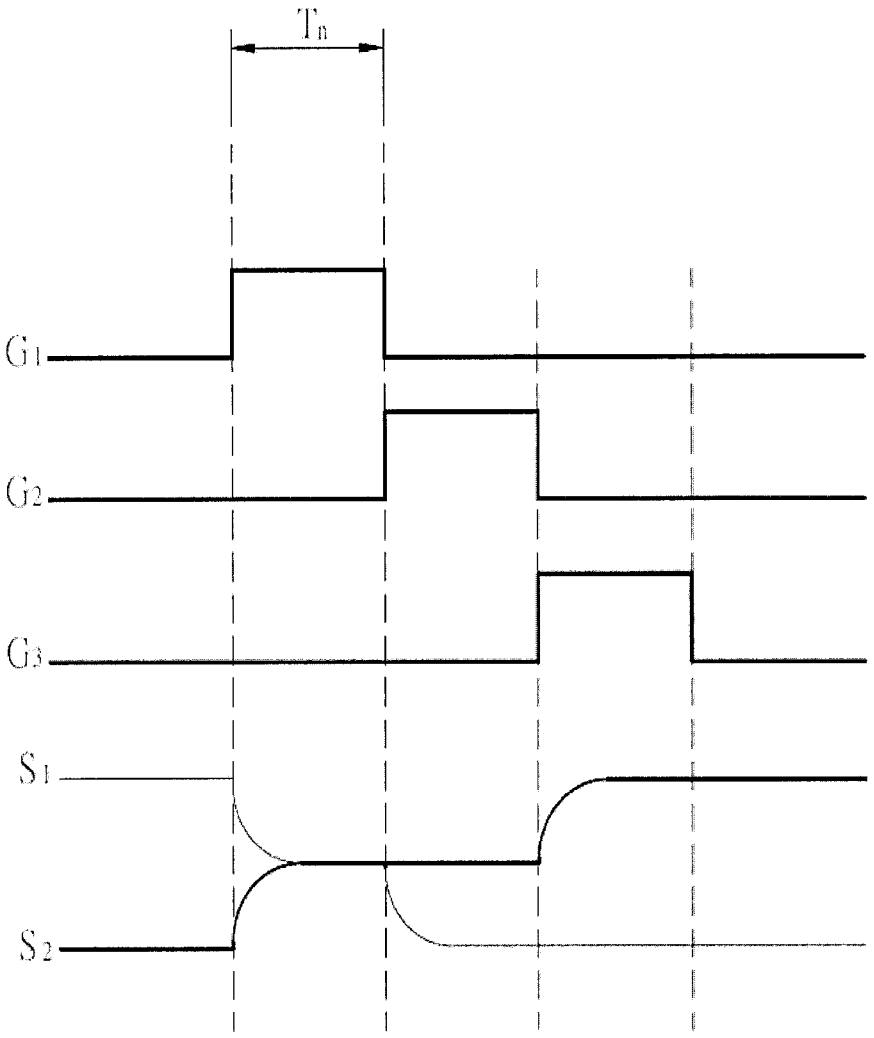
FIG. 6 is a waveform graph of scanning line-controlled charge sharing according to an embodiment of this application.

FIG. 5*a* is a schematic structural diagram of scanning line-controlled charge sharing according to another embodiment of this application, FIG. 5*b* is a schematic structural diagram of scanning line-controlled charge sharing according to still another embodiment of this application, and FIG. 6 is a waveform graph of scanning line-controlled charge sharing according to an embodiment of this application. Referring to FIG. 5*a*, a display panel 14 is provided. The display panel 14 includes: a plurality of scanning lines G1, G2, and G3; a plurality of data lines S1, S2, and S3; and a plurality of pixel units 110, 120, and 130 electrically connected to the scanning lines G1, G2, and G3 and the data lines S1 and S2 respectively. The pixel units 110, 120, and 130 include active switches W11, W12, W14, W15, W17, and W18. Control ends 111*a*, 121*a*, 141*a*, 151*a*, 171*a*, and 181*a* of the active switches W11, W12, W14, W15, W17, and W18 are connected to the corresponding scanning lines G1, G2, and G3, first ends 111*b*, 121*b*, 141*b*, 151*b*, 171*b*, and 181*b* of the active switches W11, W12, W14, W15, W17, and W18 are connected to the data lines S1 and S2, and second ends 111*c*, 121*c*, 141*c*, 151*c*, 171*c*, and 181*c* of the active switches W11, W12, W14, W15, W17, and W18 are connected to pixel capacitors (for example, storage capacitors and liquid crystal capacitors) 21, 22, 24, 25, 27, and 28. First ends 131*b* and 161*b* of charge sharing switches W13 and W16 are connected to the second ends 141*c* and 171*c* of the active switches W14 and W17 of the second pixel unit 120, and second ends 131*c* and 161*c* of the charge sharing switches W13 and W16 are connected to the second ends 151*c* and 181*c* of the active switches W15 and W18 of the third pixel unit 130.

In an embodiment, among the three scanning lines, the first scanning line is a $(2n-1)^{th}$ scanning line, the second scanning line is a $(2n)^{th}$ scanning line, and the third scanning line is a $(2n+1)^{th}$ scanning line, where n is a positive number.

Referring to FIG. 5*a*, in an embodiment, the pixel units 110, 120, and 130 include the active switches W11, W12, W14, W15, W17, and W18. The control ends 111*a*, 121*a*, 141*a*, 151*a*, 171*a*, and 181*a* of the active switches W11, W12, W14, W15, W17, and W18 are connected to the corresponding scanning lines G1, G2, and G3, the first ends 111*b*, 121*b*, 141*b*, 151*b*, 171*b*, and 181*b* of the active switches W11, W12, W14, W15, W17, and W18 are connected to the data lines S1 and S2, and the second ends 111*c*, 121*c*, 141*c*, 151*c*, 171*c*, and 181*c* of the active switches W11, W12, W14, W15, W17, and W18 are connected to the pixel capacitors (for example, storage capacitors and liquid crystal capacitors) 21, 22, 24, 25, 27, and 28. The first ends 131*b* and 161*b* of the charge sharing switches W13 and W16 are connected to the second ends 141*c* and 171*c* of the active switches W14 and W17 of the second pixel unit 120, and the second ends 131*c* and 161*c* of the charge sharing switches W13 and W16 are connected to the second ends 151*c* and 181*c* of the active switches W15 and W18 of the third pixel unit 130.

Referring to FIG. 5*a* and FIG. 6, in an embodiment, in a first scanning period, a potential of the first scanning line G1 is pulled up, the first pixel unit 110 performs charging and discharging according to signals provided by the data lines S1 and S2, and the charge sharing switches W13 and W16 are turned on, so that the second pixel unit 120 is electrically coupled to the third pixel unit 130 to perform charge sharing.

Referring to FIG. 5*a* and FIG. 6, in an embodiment, in a second scanning period, a potential of the first scanning line G1 is pulled down, a potential of the second scanning line G2 is pulled up, the charge sharing switches W13 and W16 are turned off, and the second pixel unit 120 performs charging and discharging according to signals provided by the data lines S1 and S2.

Referring to FIG. 5*a* and FIG. 6, in an embodiment, in a third scanning period, a potential of the second scanning line G2 is pulled down, a potential of the third scanning line G3 is pulled up, the charge sharing switches W13 and W16 are maintained off, and the third pixel unit 130 performs charging and discharging according to signals provided by the data lines S1 and S2.

Referring to FIG. 5*a* and FIG. 6, a charge sharing control method of a display panel includes: the display panel 14 including a plurality of pixel units arranged in a matrix manner, where three of the pixel units 110, 120, and 130 form a pixel group, the pixel group is electrically coupled to a same data line S1 or S2 and three scanning lines arranged in order, including three scanning periods, where in a first scanning period, a potential of a first scanning line G1 is pulled up, and the first pixel unit 110 performs charging and discharging according to signals provided by the data lines S1 and S2; and charge sharing switches W13 and W16 are turned on, so that a second pixel unit 120 is electrically coupled to a third pixel unit 130 to perform charge sharing, where control ends 131*a* and 161*a* of the charge sharing switches W13 and W16 are connected to the first scanning line G1, first ends 131*b* and 161*b* of the charge sharing switches W13 and W16 are connected to the second pixel unit 120, and second ends 131*c* and 161*c* of the charge sharing switches W13 and W16 are connected to the third pixel unit 130.

Referring to FIG. 5*a* and FIG. 6, in an embodiment, in the charge sharing control method of a display panel, in a second scanning period, a potential of the first scanning line G1 is pulled down, a potential of the second scanning line G2 is pulled up, the charge sharing switches W13 and W16 are turned off, and the second pixel unit 120 performs charging and discharging according to signals provided by the data lines S1 and S2.

Referring to FIG. 5*a* and FIG. 6, in an embodiment, in the charge sharing control method of a display panel, in a third scanning period, a potential of the second scanning line G2 is pulled down, a potential of the third scanning line G3 is pulled up, the charge sharing switches W13 and W16 are turned off, and the third pixel unit 130 performs charging and discharging according to signals provided by the data lines S1 and S2.

Referring to FIG. 5*a*, in an embodiment of this application, a display device includes a control part (for example, a multi-band antenna) (not shown in the figure), and further includes the display panel 14 (for example, a quantum dots light-emitting diode (QLED) panel, an organic light-emitting diode (OLED) panel, or an LCD panel, and no limitation is imposed herein).

Referring to FIG. 6, in an embodiment, in a process of switching from the scanning line G1 to scanning line G2, waveform changes of signals of pixel circuits controlled by the scanning line G2 and the scanning line G3 are shown in FIG. 6. S1 represents a waveform change of a signal of a pixel circuit 14 controlled by the scanning line G2, and S2 represents a waveform change of a signal of the pixel circuit controlled by the scanning line G3.

Referring to FIG. 3*a* and FIG. 6, in an embodiment, by controlling charge sharing switches by using the scanning lines, a charge sharing time is changed into a time in which the scanning lines are turned on. Compared with the charge sharing performed by using data lines, the time is changed from $\tau_n$ to $T_n$ (as shown in FIG. 3*a* and FIG. 6), to prolong a charge sharing time, and enhance a charge sharing effect.

Referring to FIG. 5*b*, a display panel 14 includes: a substrate 13, where active switches W11, W12, W13, W14, W15, W16, W17, and W18 are formed on the substrate 13; a plurality of data lines S1, S2, and S3, formed on the substrate; a plurality of scanning line G1, G2, and G3, formed on the substrate 13; a plurality of pixel units 110, 120, and 130 arranged in a matrix manner, where the three pixel units 110, 120, 130 form a pixel group, coupled to any of the data lines S1, S2, and S3 and the three scanning line G1, G2, and G3 arranged in an order, and including: a first pixel unit 110, coupled between a first scanning line G1 and the data lines S1, S2, and S3; a second pixel unit 120, coupled between a second scanning line G2 and the data lines S1, S2, and S3; and a third pixel unit 130, coupled between a third scanning line G3 and the data lines S1, S2, and S3; and charge sharing switches W13 and W16, where control ends 131*a* and 161*a* of the charge sharing switches W13 and W16 are connected to the first scanning line G1, first ends 131*b* and 161*b* of the charge sharing switches W13 and W16 are connected to the second pixel unit 120, and second ends 131*c* and 161*c* of the charge sharing switches W13 and W16 are connected to the third pixel unit 130.

Referring to FIG. 5*b*, a display panel 14 includes: a substrate 13, where active switches W11, W12, W13, W14, W15, W16, W17, and W18 are formed on the substrate 13; a plurality of data lines S1, S2, and S3, formed on the substrate; a plurality of scanning line G1, G2, and G3, formed on the substrate 13; a plurality of pixel units 110, 120, and 130 arranged in a matrix manner, where the three pixel units 110, 120, 130 form a pixel group, coupled to any of the data lines S1, S2, and S3 and the three scanning line G1, G2, and G3 arranged in an order, and including: a first pixel unit 110, coupled between a first scanning line G1 and the data lines S1, S2, and S3; a second pixel unit 120, coupled between a second scanning line G2 and the data lines S1, S2, and S3; and a third pixel unit 130, coupled between a third scanning line G3 and the data lines S1, S2, and S3; and charge sharing switches W13 and W16, where control ends 131*a* and 161*a* of the charge sharing switches W13 and W16 are connected to the first scanning line G1, first ends 131*b* and 161*b* of the charge sharing switches W13 and W16 are connected to the second pixel unit 120, and second ends 131*c* and 161*c* of the charge sharing switches W13 and W16 are connected to the third pixel unit 130. The data lines S1, S2, and S3 may be a same data line or any one of the data lines S1, S2, and S3.

In this application, charge sharing is performed directly on pixel circuits, to prolong a charge sharing time and enhance a charge sharing effect, and charge sharing of charges may be performed by means of a dot inversion or a column inversion without being controlled by an additional timing signal, thereby improving quality of a display screen.

The wordings such as "in some embodiments" and "in various embodiments" are repeatedly used. The wordings usually refer to different embodiments, but they may also refer to a same embodiment. The words, such as "comprise", "have", and "include", are synonyms, unless other meanings are indicated in the context thereof.

The foregoing descriptions are merely specific embodiments of this application, and are not intended to limit this application in any form. Although this application has been disclosed above through the specific embodiments, the embodiments are not intended to limit this application. Any person skilled in the art can make some variations or modifications, namely, equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A display panel, comprising:

a substrate, wherein active switches are formed on the substrate;

a plurality of pixel units arranged in a matrix manner, wherein three of the pixel units form a pixel group, coupled to a data line and three scanning lines arranged in order, and the pixel group comprises:

a first pixel unit, coupled between a first scanning line and the data line;

a second pixel unit, coupled between a second scanning line and the data line; and a third pixel unit, coupled between a third scanning line and the data line; and a charge sharing switch, wherein a control end of the charge sharing switch is connected to the first scanning line, a first end of the charge sharing switch is connected to the second pixel unit, and a second end of the charge sharing switch is connected to the third pixel unit, wherein in a first scanning period, a potential of the first scanning line is pulled up, the first pixel unit performs charging and discharging according to a signal provided by the data line, and the charge sharing switch is turned on, so that the second pixel unit is electrically coupled to the third pixel unit to perform charge sharing;

wherein in a second scanning period, a potential of the first scanning line is pulled down, a potential of the second scanning line is pulled up, the charge sharing switch is turned off, and the second pixel unit performs charging and discharging according to a signal provided by the data line; and wherein in a third scanning period, a potential of the second scanning line is pulled down, a potential of the third scanning line is pulled up, the charge sharing switch is maintained off, and the third pixel unit performs charging and discharging according to a signal provided by the data line.

2. The display panel according to claim 1, wherein among the three scanning lines, the first scanning line is a $(2n-1)^{th}$ scanning line.

3. The display panel according to claim 2, wherein the second scanning line is a $(2n)^{th}$ scanning line.

4. The display panel according to claim 3, wherein the third scanning line is a $(2n+1)^{th}$ scanning line, wherein n is a positive number.

5. The display panel according to claim 1, wherein each of the pixel units comprises an active switch.

6. The display panel according to claim 5, wherein a control end of the active switch is connected to a corresponding one of the scanning lines, a first end of the active switch is connected to the data line, and a second end of the active switch is connected to a pixel capacitor.

7. The display panel according to claim 5, wherein the first end of the charge sharing switch is connected to a second end of an active switch of the second pixel unit.

8. The display panel according to claim 5, wherein the second end of the charge sharing switch is connected to a second end of an active switch of the third pixel unit.

9. A display panel, comprising:

a substrate, wherein active switches are formed on the substrate;

a plurality of pixel units arranged in a matrix manner, wherein three of the pixel units form a pixel group, coupled to any data line and three scanning lines arranged in order, and the pixel group comprises:

a first pixel unit, coupled between a first scanning line and the data line;

a second pixel unit, coupled between a second scanning line and the data line; and a third pixel unit, coupled between a third scanning line and the data line; and a charge sharing switch, wherein a control end of the charge sharing switch is connected to the first scanning line, a first end of the charge sharing switch is connected to the second pixel unit, and a second end of the charge sharing switch is connected to the third pixel unit, wherein the data line is a same data line or any data line, wherein in a first scanning period, a potential of the first scanning line is pulled up, the first pixel unit performs charging and discharging according to a signal provided by the data line, and the charge sharing switch is turned on, so that the second pixel unit is electrically coupled to the third pixel unit to perform charge sharing;

wherein in a second scanning period, a potential of the first scanning line is pulled down, a potential of the second scanning line is pulled up, the charge sharing switch is turned off, and the second pixel unit performs charging and discharging according to a signal provided by the data line; and wherein in a third scanning period, a potential of the second scanning line is pulled down, a potential of the third scanning line is pulled up, the charge sharing switch is maintained off, and the third pixel unit performs charging and discharging according to a signal provided by the data line.

* * * * *